US006959892B2

(12) United States Patent
Sanda

(10) Patent No.: US 6,959,892 B2
(45) Date of Patent: Nov. 1, 2005

(54) REEL FOR FINE METAL WIRE AND METHOD OF MANUFACTURING SAME

(75) Inventor: Kenji Sanda, Ono (JP)

(73) Assignee: Tokusen Engineering Co., Ltd., Ono (JP)

( * ) Notice: Subject to any disclaimer, the term of this patent is extended or adjusted under 35 U.S.C. 154(b) by 0 days.

(21) Appl. No.: 10/246,767

(22) Filed: Sep. 19, 2002

(65) Prior Publication Data

US 2003/0071611 A1 Apr. 17, 2003

(30) Foreign Application Priority Data

Sep. 19, 2001 (JP) ..... 2001-285389

(51) Int. Cl.[7] ..... B65H 75/18

(52) U.S. Cl. ..... 242/608.8; 242/610.5; 242/614.1

(58) Field of Search ..... 242/614.1, 608, 242/608.2, 608.3, 608.4, 608.7, 608.8, 610.1, 610.5, 118.6, 118.61, 118.62, 118.7, 118.8

(56) References Cited

U.S. PATENT DOCUMENTS

| | | | | |
|---|---|---|---|---|
| 1,380,670 A | | 6/1921 | Mossberg | |
| 1,472,980 A | * | 11/1923 | Hubbard | 242/118.8 |
| 1,522,330 A | | 1/1925 | Sayres | |
| 1,712,278 A | * | 5/1929 | Mills | 242/118.8 |
| 1,880,439 A | * | 10/1932 | Hathaway et al. | 242/614.1 |
| 2,006,281 A | * | 6/1935 | Schwarz | 29/506 |
| 2,076,084 A | * | 4/1937 | Howsam | 242/118.61 |
| 2,121,234 A | * | 6/1938 | Howsam | 242/614.1 |
| 2,258,580 A | * | 10/1941 | Olson | 242/118.8 |
| 2,272,156 A | | 2/1942 | Olson | |
| 2,316,028 A | | 4/1943 | Tucker, Jr. | |
| 2,321,084 A | * | 6/1943 | Howsam et al. | 242/614.1 |
| 2,521,922 A | * | 9/1950 | Kurtz | 242/614.1 |
| 3,412,953 A | | 11/1968 | Morris | |
| 5,106,031 A | | 4/1992 | Sanda et al. | |

FOREIGN PATENT DOCUMENTS

| | | |
|---|---|---|
| JP | 2523990 Y2 | 10/1996 |
| JP | 2534746 Y2 | 2/1997 |
| JP | 3067526 U | 1/2000 |

* cited by examiner

*Primary Examiner*—Kathy Matecki
*Assistant Examiner*—Scott J. Haugland
(74) *Attorney, Agent, or Firm*—Browdy and Neimark, PLLC

(57) ABSTRACT

This invention provides a reel 1 for a fine metal wire comprising a drum 2, two flange bodies 3, and two flange reinforcing members 4 each of them made of thin steel metal. Each flange reinforcing members 4 is bent into L-shape in cross-section such that a flange side portion 4*a* is placed at a tilt angle θ of 4 +3/−3 degrees with respect to a vertical line. The flange side portion 4*a* of the flange reinforcing member 4 is brought into intimate contact with a flange 3*b* of the flange body to be fixed thereto by spot welding. As a result, a tensile stress is previously produced at the bent portion P, thereby substantially improving the strength and the repetitive usability.

3 Claims, 3 Drawing Sheets

(b)

(a)

(b)

REEL FOR FINE METAL WIRE AND METHOD OF MANUFACTURING SAME

BACKGROUND OF THE INVENTION

1. Field of Invention

The present invention relates to a reel on which a fine metal wire is wound. In particular, the present invention relates to a reel for a fine metal wire (hereinafter referred to as just "reel") designed to wind thereon a fine metal wire, including a wire for a wire saw (hereinafter referred to as "saw wire") to cut hard material such as artificial crystal, silicon, ceramic, or the like, and a wire for a rubber hose for reinforcement (hereinafter referred to as "hose wire").

2. Description of the Prior Art

A conventional reel 11 as shown in FIG. 5, has a drum 12, and flanges 13, 13 disposed at the ends of the drum. The drum 12 and the flanges 13 are made of thick steel sheets such as carbon steels for machine structural use (for example, S45C/JIS), or the like. Depending on manufacturing method, some kinds of reels have been known, including an integral reel which is made by cutting out the drum and the flange as one piece, and a welded reel into which three divided parts, namely, the drum and both flanges are welded together.

A fine metal wire to be wound on the above-mentioned reel is, for example, a fine metal wire having a diameter of 0.12 to 0.16 mm or less and serving as a saw wire, or a fine metal wire having a diameter of about 0.20 to 0.80 mm and serving as a hose wire. Also, the fine metal wire, which is to be wound on the described reel, may be, for example, a fine metal wire having a diameter of about 0.15 to 0.40 mm and serving as a wire of a twisting steel cord (namely, a tire cord) for reinforcing rubber products, which contains a steel cord functioning as a metal twisting wire in some cases. In a case where the above-mentioned fine metal wire is wound on the reel under a predetermined tension (for example, a tension of 0.4 kg to 1.5 kg), the winding tension causes a high tightening tension to the drum, thus resulting in applying to the flanges a big force pushing them apart. And this force for pushing apart (hereinafter referred to as "side pressure") causes the flanges at both ends to be pushed away in a direction that they separate from each other.

As the diameter of the metal wire becomes smaller, or as the winding tension becomes larger, or as the reciprocating number of turns of the wire becomes larger, the side pressure generated becomes larger. For example, in a case where the above-mentioned extra fine metal wire is a saw wire, weight of 40 kg to 60 kg or more is applied to the reel. In this case, the side pressure thereof sometimes reaches several tons or several tens of tons.

To provide sufficient strength and rigidity to withstand such side pressure, the conventional reel 11 utilizes the thick steel sheet having a thickness of about 20 to 50 mm. Accordingly, the conventional reel is so heavy that the operability thereof becomes very poor, and that the reel suffers from the high cost of transportation. Also, the conventional reel suffers from the high cost of materials and treatments.

Additionally, even this mechanically strong reel, since the generated side pressure is excessively large, cannot avoid plastic deformation of the flanges and the drum. After repeated use of several times, or 10 times or more, the deformation of the reel is proceeding, or the reel is broken to become unusable. That is, the conventional reel has a disadvantage that it fails to ensure durability appropriate to the high costs.

OBJECT AND SUMMARY OF THE INVENTION

Therefore, it is an object of the present invention to provide a reel for a extra fine metal wire having sufficient mechanical strength and repetitive usability, while achieving reduction in weight and cost, and a method of manufacturing same.

The present invention has been accomplished on the basis of the following findings from analytical study of causes of reel deformation. That is, the conventional reel utilizes a thick steel sheet having high strength and great rigidity, so as to enlarge a force withstanding a side pressure upon taking up a wire, thus making the amount of deformation of the flanges small when the side pressure is applied. However, the small amount of the deformation of the flanges is inversely a weak point. That is why, in substantial proportion to a wound amount of the wire, the side pressure becomes high. And when the wire is wound full on the reel, the excessive high side pressure is applied to the flanges, resulting in occurrence of the deformation of the flanges, which are made of the thick steel sheet. Thereafter in the case of unwinding the wire, the deformation of the flanges remains. And this deformation is further accumulated and proceeds by repeated use of the reel, thus leading to the severe deformation or the serious breakage of the reel that makes the reel unusable.

According to the present invention, there is provided a reel for a fine metal wire comprising a drum, two flange bodies, coupled to said drum, and two flange reinforcing members, positioned within said flange bodies, each of which being made of thin steel metal, and being welded together by spot welding, wherein a flange side portion of said flange reinforcing members having a tensile stress so that it can give the flange of said flange bodies towards said drum side.

In the reel of the present invention, the flange body and the flange reinforcing member (both of which are hereinafter referred to as "flange portion") each are made of the thin steel sheets. The flange portion has a double-layer structure to accept the side pressure, so that the flange portion is deformed when the pretty big side pressure is applied. Accordingly, the reel of the present invention has the function of relieving the side pressure, whereby no excessive side pressure is produced in the reel as distinct from in the conventional thick reel. Thus, while the wire is being wound on each other around the reel, the flange portion deforms in a range without exceeding the range of the plastic deformation.

Next, as the wire is unwound from the reel, and the wound amount thereof decreases, the deformation of the flange portion diminishes with decreasing side pressure, so that the reel is restored to its original form. As described above, the reel of the present invention utilizes the elasticity (restoration) of the thin steel sheet to restrain the cumulative increment of the side pressure in the reel, thereby suppressing the plastic deformation of the flange portion to improve the repetitive usability (durability) of the reel.

Furthermore, since the flange side portion of the flange reinforcing member has the tensile stress to pull the flange of the flange body towards the drum side, a force is constantly provided (even in a state where no wire is wound on the reel) to pull the flange portion in a direction opposite to the direction of the side pressure. Accordingly, when the side pressure is applied to the flange portion, repulsion occurs to restrain the deformation of the flange portion. Also, in a case where the wire has just been unwound from the reel, and the side pressure is released, a restoration force acts on the flange portion to restore it to its original form. Therefore, even the reel utilizing the thin steel sheet, can have the strength and the repetitive usability sufficient to serve as the reel for the extra fine metal wire.

Next, according to another aspect of the present invention, there is provided a method of manufacturing a reel for a fine metal wire, wherein the reel has a drum, a flange body and a flange reinforcing member, each of which is made of a thin steel sheet. The method comprises the steps of forming the flange reinforcing member such that a flange side portion of the flange reinforcing member is placed at a tilt angle of 4 degrees+3/−3 degrees towards a drum side with respect to an end surface of a flange of the flange body, and thereafter welding the above-mentioned flange reinforcing member, the flange body, and the drum together by spot welding.

In the present invention, the reason why the tilt angle of the flange side portion of the flange reinforcing member is in a range of 4 degrees+3/−3 degrees is that, when the tilt angle is less than 1 degree, the generated tensile stress is so small that the strength and the repetitive usability of the flange portion becomes insufficient. Also, when the tilt angle is 7 degrees or more, the workability upon the spot welding is prone to deteriorate.

The reel of the present invention is efficiently applicable to the winding of the single fine metal wire having a diameter of 0.22 mm or less, such as the saw wire or the horse wire. That is, when the diameter of the metal is 0.20 mm or less, the side pressure occurring upon the taking up thereof becomes large. In particular, the present invention is preferably used for the taking up of the saw wire, thereby to provide the light and mechanically strong reel which achieves reduction in material costs and manufacturing costs, and which has a big restoration force so as to be repeatedly utilized.

To efficiently perform the functions as described above, the material of a flange body and a flange reinforcing member could be a thin steel sheet having high tension and high elasticity. Preferably, the material is, for example, SAPH/JIS (hot-rolled plates, sheets and strip), or SPCC/JIS (cold-reduced carbon carbon steel sheets and strip). It is noted that other existing steel sheet (for example, S45C) may be used, but this is so less elastic that it is likely to be plastically deformed by the side pressure.

The flange body has a thickness of preferably 1.2 to 2.0 mm. If its thickness is less than 1.2 mm, it has sufficient elasticity but poor strength, not to be able to withstand high side pressure. In contrast, if its thickness is more than 2.0 mm, it has sufficient strength to withstand the side pressure, but less elasticity only to have poor restoration responsive to its deformation.

The flange reinforcing member has a thickness of preferably 0.6 to 2.0 mm. The reason for this size is the same as that in the case of the flange body described above.

The thickness of the flange body and the flange reinforcing member could be determined on the basis of some conditions, such as a diameter of a wire, winding tension thereof, and the like.

Moreover, a flange of the flange body preferably has ribs disposed radially, each of which has a slender groove on the inner side thereof, and which protrudes towards the outside, thereby further enhancing the strength to withstand the side pressure of the flange body. In this case, since the flange reinforcing member is inscribed in a substantially whole surface of the flange body, the slant grooves of the ribs are completely covered with the flange reinforcing member. Accordingly, the wire is never fitted into the slant grooves, thereby enhancing the quality of the wire winding.

The flange body is manufactured by press working of the thin steel metal, the outer periphery of which is generally reinforced by a folding procedure thereof. Also, the ribs for reinforcement, which are radially disposed in the flange of the flange body, are manufactured by the press working. The number of the ribs is preferably 8 to 16.

The flange body and the drum could be are grooved or recessed by the thickness of the flange reinforcing member, and into the grooves is fitted the flange reinforcing member, thereby improving the winding form of the wire to prevent entanglement or a break in the wire.

Additionally, on the inner periphery of the drum (on the inner side of the drum), there could be are provided one or more disc-shaped or ring-shaped reinforcing members, thus improving the strength of the drum against the tightening tension to suppress the deformation of the drum.

Cutting the inner and outer peripheral edges of the flange reinforcing member can provide the reel without edges, thus smoothing steps between the flange body and the drum. This can prevent not only entanglement or a break in the wire as soon as possible when taking up or unwinding, but also prevent a break or a disorder of the winding form.

According to the present invention, there is provided a reel to have sufficient strength and repetitive usability even when an extra fine metal wire such as a saw wire, a hose wire, or the like is wound thereon. Therefore, in comparison with the conventional reel utilizing a thick steel sheet, the reel of the present invention permits substantial reduction in manufacturing costs. Also, the reel allows significant reduction in weight, thereby substantially improving operability thereof to further reduce the cost of transportation.

The above, and other objects, features and advantages of the invention will become apparent from the following detailed description which is to be read in conjunction with the accompanying drawings.

DESCRIPTION OF THE PREFERRED EMBODIMENT

Figure 1:
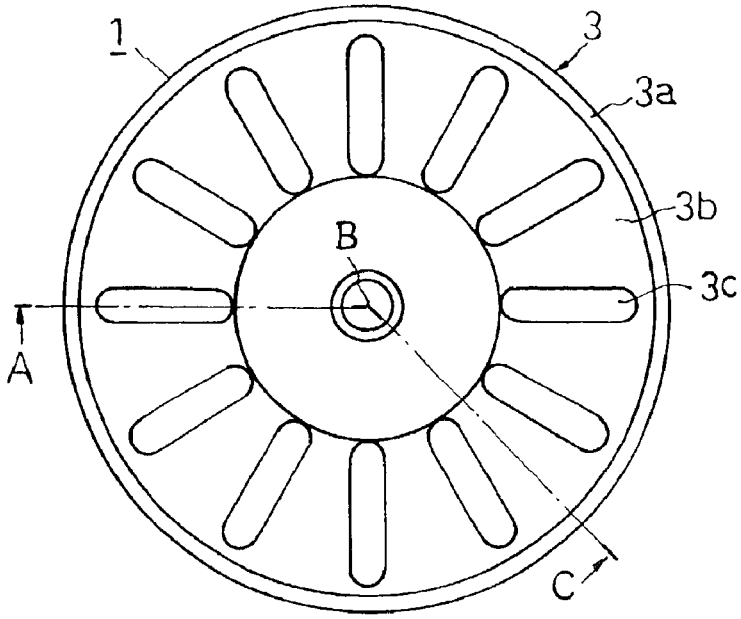
FIG. 1 (*a*) is a plan view of a reel according to an example of the present invention, and FIG. 1 (*b*) is a partially sectional view thereof.
Figure 1:
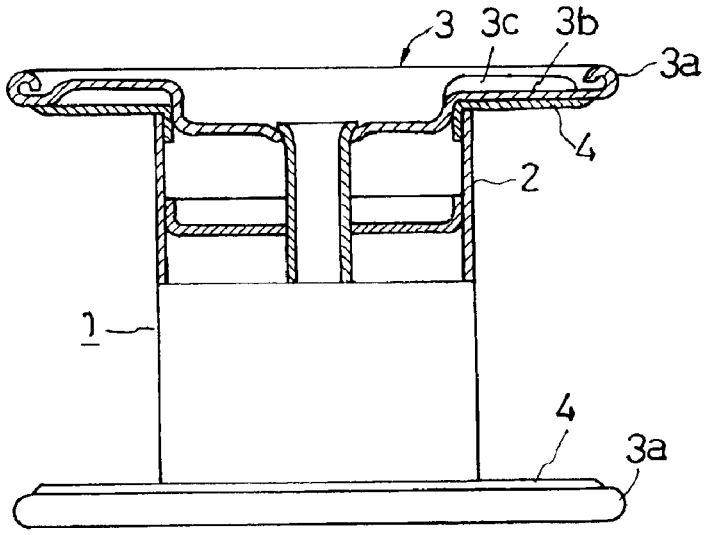
Figure 2:
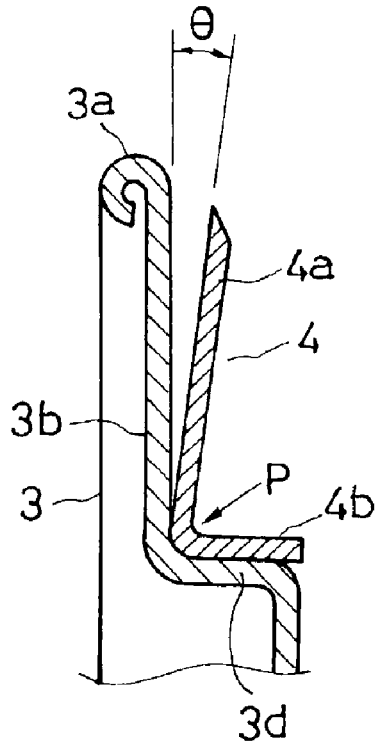
FIG. 2 is a fragmentary sectional view illustrating a manufacturing process of the reel according to the example of the present invention.
Figure 3:
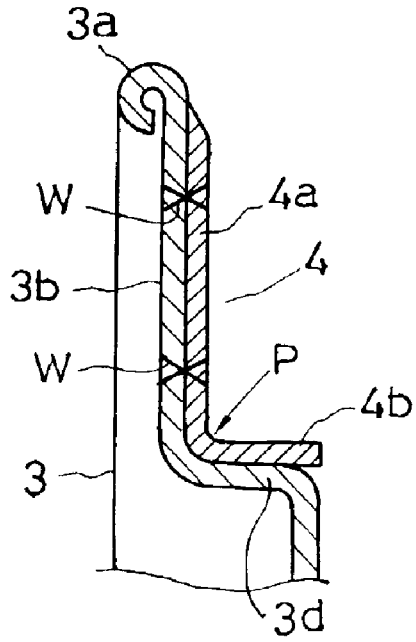
FIG. 3 is a fragmentary sectional view illustrating a manufacturing process of the reel according to the example of the present invention.
Figure 4:
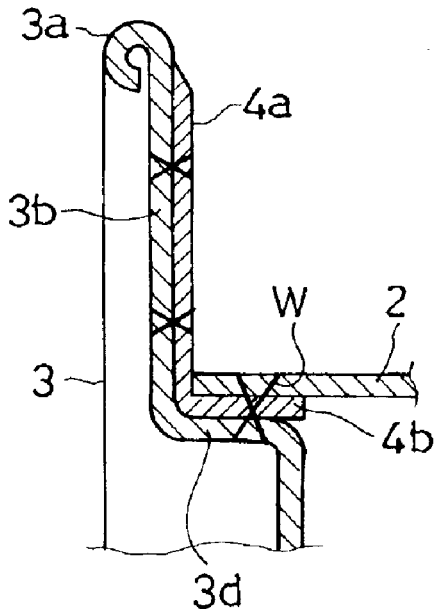
FIG. 4 is a fragmentary sectional view illustrating a manufacturing process of the reel according to the example of the present invention.
Figure 5:
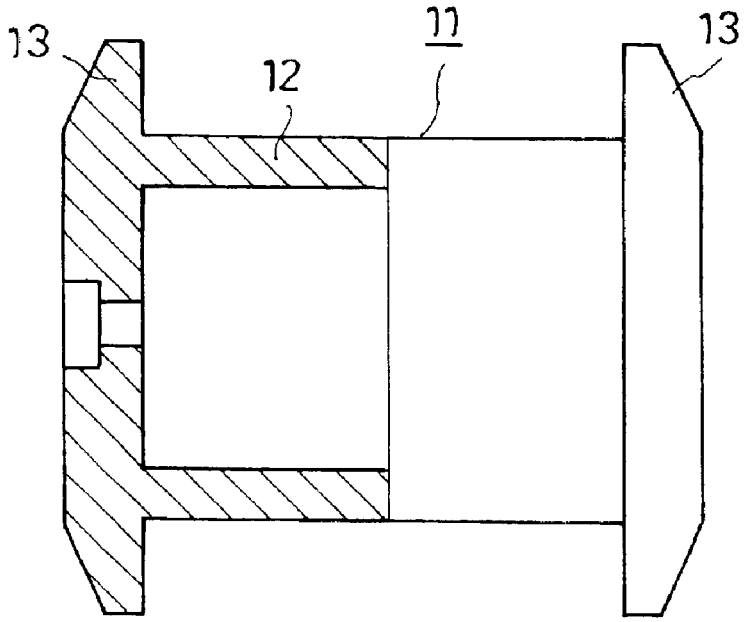
FIG.5 PRIOR ART
FIG. 5 is a partially fragmentary side view illustrating a conventional reel using a thick steel sheet.

FIG. 1 shows an example of a reel according to the present invention. FIG. 1 (*a*) is a plan view of the reel, and FIG. 1 (*b*) is a partially sectional view thereof taken along the line A-B-C. Each of FIGS. 2 to 4 is a fragmentary sectional view illustrating manufacturing process of the reel in FIG. 1.

As shown in FIG. 1, a drum 2, flange bodies 3, 3, flange reinforcing members 4, 4, and other components are welded together by spot welding to form a reel 1 in accordance with the present invention.

The drum 2 is formed by bending a cold rolled high tensile steel sheet (SAFC) that has a thickness of 1.2 mm into a cylindrical shape.

The flange body 3 is formed by stamping a hot rolled high tensile steel sheet (SAPH) that has a thickness of 1.6 mm. On the outer periphery of the flange body is provided a folded portion 3*a* for reinforcement. Also, a flange 3*b* of the flange body has twelve ribs 3*c* for the reinforcement formed radially by a stamping technique. Additionally, on the inner side of the flange body, engagement portions 3*d* are provided by the stamping technique to engage with the inner peripheral surface of the drum 2.

The flange reinforcing member 4 is formed by stamping a hot rolled high tensile steel sheet that has a thickness of 1.0 mm into a doughnut and disc shape. The flange reinforcing member 4 has the inner periphery of the disc shape bent into a sectional L-shape so as to be welded to the drum by spot welding.

Now, an example of detailed construction of the flange reinforcing member and manufacturing processes of the reel will be described hereinafter with reference to FIG. 2 to FIG. 4.

The flange reinforcing member 4 is bent into the L-shape in cross section such that a flange side portion 4*a* is placed at a tilt angle θ of 4 degrees+3/−3 degrees with respect to a vertical line. And the flange reinforcing member 4 is ring-shaped, which has the flange side portion 4*a* and a drum side portion 4*b* that are separated from each other with a bent portion P being a boundary therebetween.

The manufacturing processes of the reel are as follows. First, as shown in FIG. 2, the flange reinforcing member 4 is fitted into the flange body 3. Then the flange side portion 4*a* of the flange reinforcing member comes into contact with the flange 3*b* of the flange body, and the drum side portion 4*b* of the flange reinforcing member comes into contact with the engagement portion 3*d* of the flange body. In this step, the flange body and the flange reinforcing member are separated by the tilt angel θ, which is formed between the flange side portion 4*a* of the flange reinforcing member and the flange 3*b* of the flange body. Therefore, no stress occurs at the bent portion P.

Next, as shown in FIG. 3, the flange side portion 4*a* of the flange reinforcing member is brought into intimate contact with the flange 3*b* of the flange body to be fixed thereto by spot welding W, W, thereby to form a flange portion. At this time, a tensile stress is produced at the bent portion P, whereby the flange side portion of the flange reinforcing member has a tensile stress to pull the flange of the flange body towards the inside.

Thereafter, as shown in FIG. 4, the drum side portion 4*b* of the flange reinforcing member is fitted into the inner periphery of the drum 2 to be fixed thereto by spot welding W.

As described above, the reel has been manufactured.

Next, the strength and repetitive usability of the reel is checked by using a reel having the tilt angle θ of 4 degrees of the present invention and a reel having the tilt angle θ of 0 degree as an example for comparison, to wind a saw wire on each reel, and by comparing the above properties between these reels. The strength of the reel is determined based on a distance between the flanges when the whole wire is wound on the reel. Further, the repetitive usability of the reels is determined based on a change in a distance between the flanges of the reel without the wire, after repeating the winding and unwinding procedures of the wire over five times. The results will be shown in Table 1 below.

It should be noted that the material and the thickness of each component in the reel of the comparison example is the same as that in the reel of the present invention. A size of each part in the reel and a diameter of the saw wire are as follows:

Distance between Flanges: 315 mm

Diameter of Drum: 120 mm

Outer Diameter of Flange Body: 255 mm

Diameter of Saw Wire: 0.16 mm

Winding Tension: 0.45 kg

TABLE 1

| | Strength: Distance between Flanges after | Repetitive Usability: | |
|---|---|---|---|
| | One Time Full Winding Procedure (mm) | Distance between Flanges of Reel with No Wire after One Time Use (mm) | Distance between Flanges of Reel with No Wire after 5 Times Use (mm) |
| Present Invention | 320.2 | 316.6 | 317.8 |
| Comparison Example | 323.6 | 318.3 | 324.1 |

As shown in Table 1, it is apparent that the tilt angle in the reel of the present invention results in improved strength and repetitive usability of the reel.

In the case of the comparison example, since the distance between the flanges is significantly expanded, the unnecessary mesh or crumbling of the wound wire occurs to frequently cause the breakage of the wire during the unwinding procedure.

What is claimed is:

1. A reel for a fine metal wire comprising:

a drum;

two flange bodies each comprising a flange, said flange bodies, coupled to said drum; and two flange reinforcing members, positioned within said flange bodies, said reinforcing members each substantially covering the entire surface of one side of the flange of one of the flange bodies, each of which being made of thin steel metal, and being welded together by spot welding, wherein a flange side portion of said flange reinforcing members has a preloaded tensile stress to pull the flange of the flange body toward the drum.

2. The reel for the fine metal wire according to claim 1, wherein said flange body has a thickness of 1.2 to 2.0 mm, and wherein said flange reinforcing member has a thickness of 0.6 to 2.0 mm.

3. A method of manufacturing a reel for a fine metal wire, the reel having a drum, two flange bodies and two flange reinforcing members, each of which is made of a thin steel sheet, the method comprising the steps of:

forming said flange reinforcing members such that a flange side portion of the flange reinforcing members is placed all around at a tilt angle of 4 +3/−3 degrees towards a drum side with respect to an end surface of a flange of said flange bodies before welding; and welding said flange reinforcing members, said flange bodies, and said drum together by spot welding, wherein said flange reinforcement members are inscribed in a substantially whole surface of the flange of the flange body.

* * * * *